US006135599A

United States Patent [19]

Fang

[11] Patent Number: 6,135,599

[45] Date of Patent: Oct. 24, 2000

[54] PROJECTION ORNAMENT

[76] Inventor: Chen-Tai Fang, P.O. Box 82-144, Taipei, Taiwan

[21] Appl. No.: 09/276,645

[22] Filed: Mar. 26, 1999

[51] Int. Cl.[7] ..... A63H 33/22; G03B 21/14

[52] U.S. Cl. ..... 353/98; 353/28; 472/58; 446/219

[58] Field of Search ..... 353/1, 23, 42, 353/43, 95, 96, 98, 100, 120, 28; 472/58; 446/219, 485

[56] References Cited

U.S. PATENT DOCUMENTS

| | | | |
|---|---|---|---|
| 720,877 | 2/1903 | Bloch | 472/58 |
| 728,063 | 5/1903 | Wilson | 472/58 |
| 4,072,314 | 2/1978 | Rosen et al. | 472/58 |
| 4,902,117 | 2/1990 | Papp | 353/28 |
| 5,228,879 | 7/1993 | Fromm | 472/58 |
| 5,515,120 | 5/1996 | Burillo Gilmartin | 353/74 |

*Primary Examiner*—William Dowling
*Attorney, Agent, or Firm*—A & J

[57] ABSTRACT

A projection ornament, which includes a lens having a first side that admits light and a second side that reflects light, a light permeable element, which can be a transparent film having a design printed on it or a transparent resin disk having a sculpture embedded in it, adhered to the first side of the lend, and a light source controlled to emit light through the light permeable element into the first side of the lens, enabling the image of the design or sculpture in the light permeable element to be seen through the second side of the lens.

1 Claim, 7 Drawing Sheets

PROJECTION ORNAMENT

BACKGROUND OF THE INVENTION

The present invention relates to a projection ornament which reflects light when a back light is turned off, or shows the image of a design when the back light is turned on.

Conventional display toys are designed to show different patterns, or used with sound and light producing means to produce sound and lighting effects. The patterns provided in conventional display toys are not changeable. For example, in a display toy which shows the story of "Snow White" with the witch facing the magic mirror and questioning the magic mirror "who is the most beautiful woman in the world?", the magic mirror can only reflect the face of the witch. According to conventional designs, the image of the witch and the image of the queen cannot be interchangeably appeared in the magic mirror.

SUMMARY OF THE INVENTION

The present invention provides a projection ornament which reflects light when the back light which is provided behind a lens thereof is turned off, or shows the image of a design in the lens when the back light is turned on.

DETAILED DESCRIPTION OF THE PREFERRED EMBODIMENT

Figure 1:
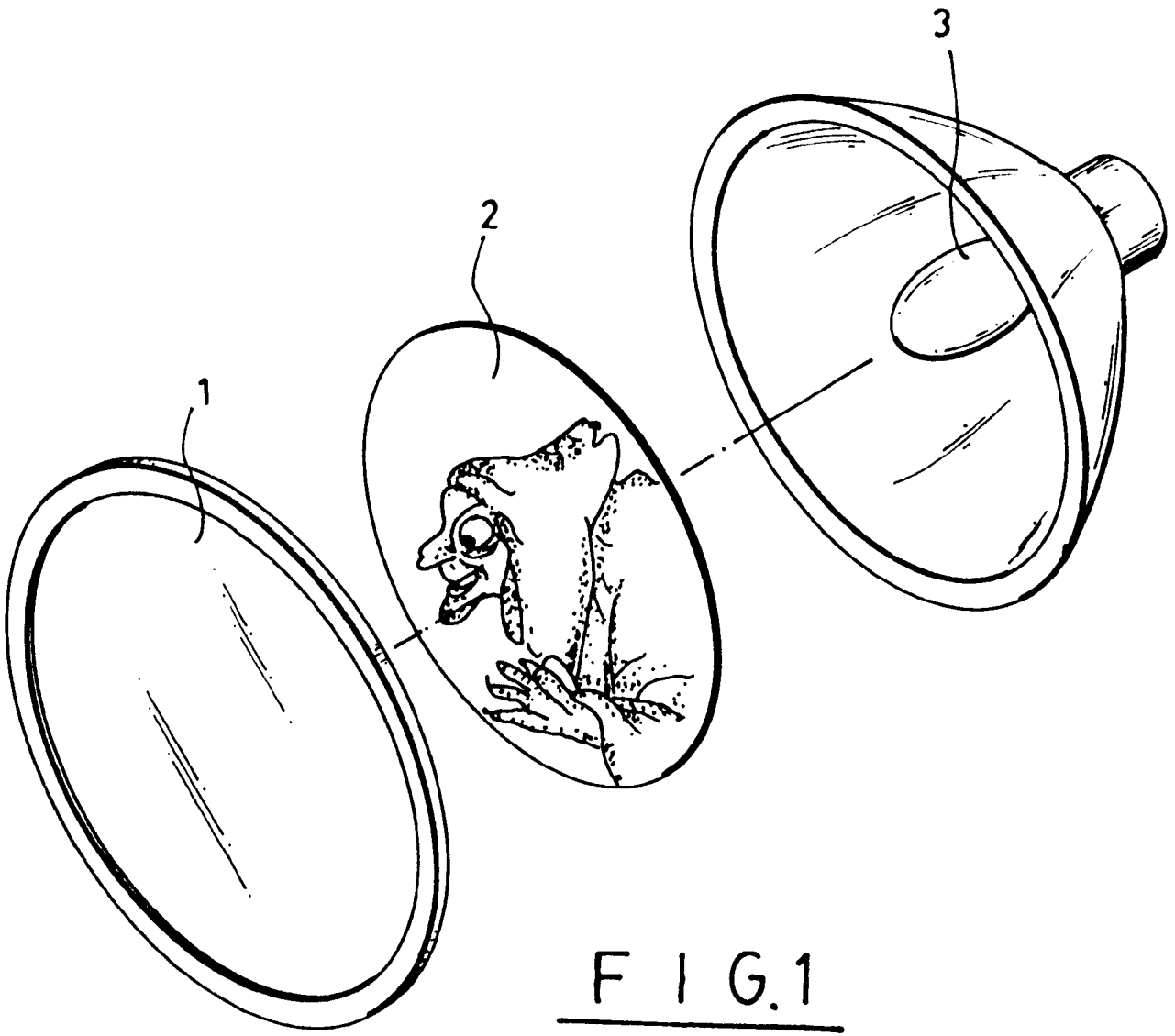
FIG. 1 is an exploded view of a projection ornament according to the present invention.
Figure 2:
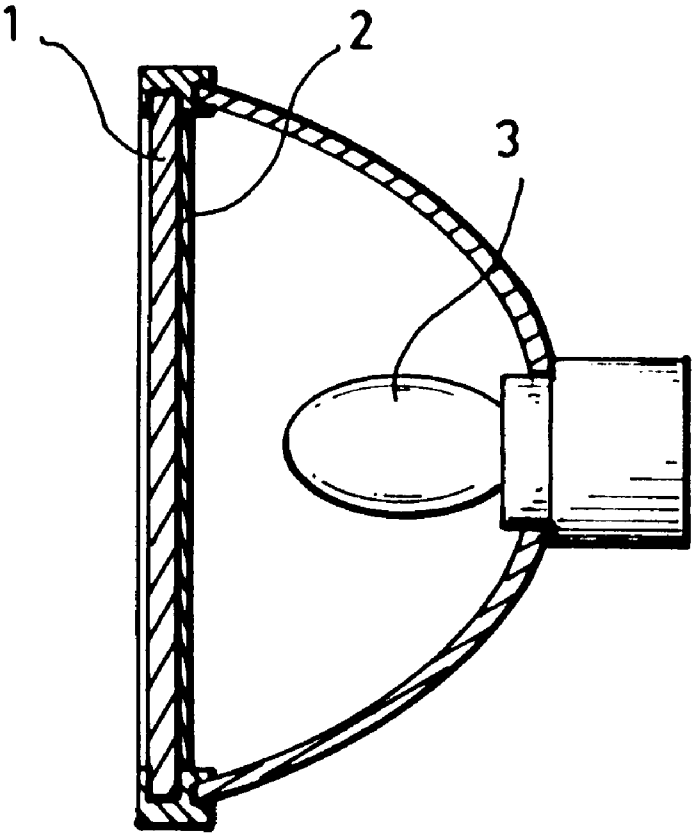
FIG. 2 is a sectional assembly view of the projection ornament shown in FIG. 1.
Figure 3:
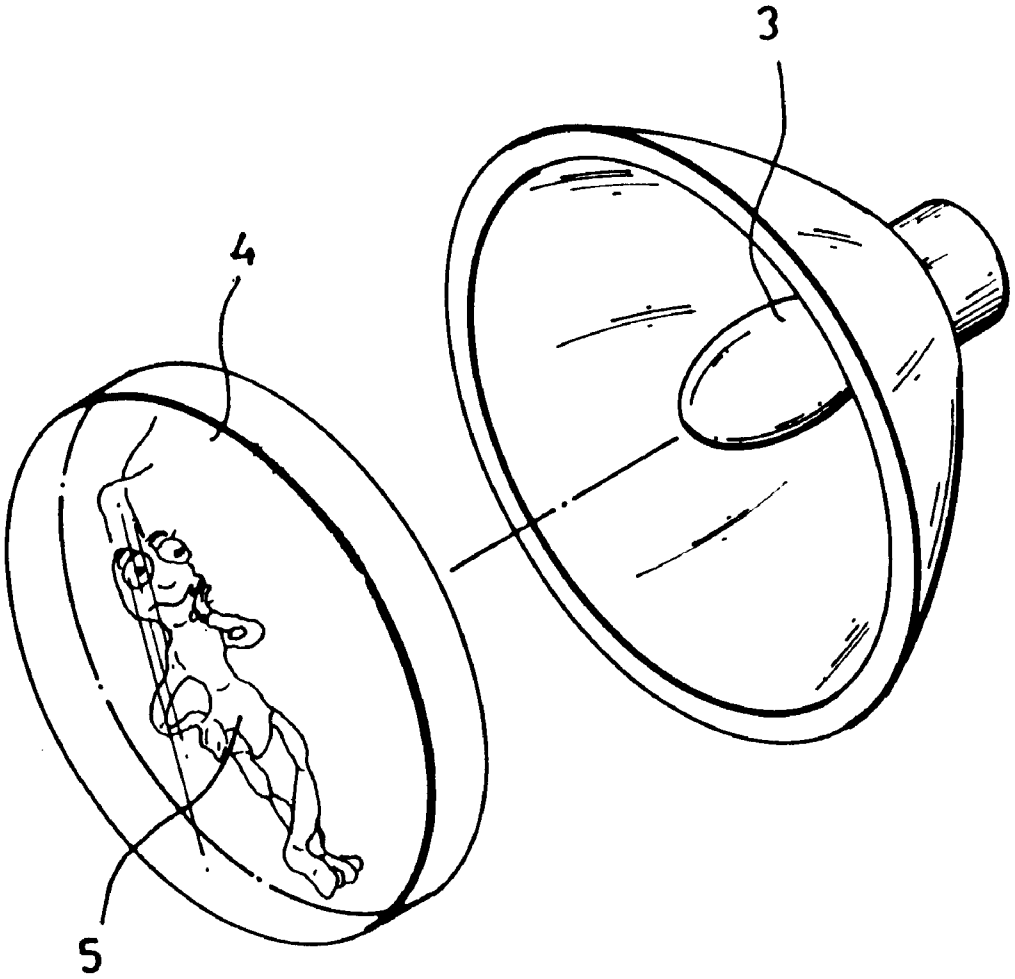
FIG. 3 is an exploded view of an alternate form of the present invention (the lens excluded).

Referring to FIGS. 1 and 2, a projection ornament in accordance with the present invention is generally comprised of a lens 1, a light permeable element, and a light source or example a lamp 3. The light permeable element can be a transparent film 2 having a design printed on it (see FIG. 1), or a transparent resin disk 4 having a sculpture 5 embedded in it (see FIG. 3). The lens 1 has one side that admits light, and an opposite side that reflects light. The transparent film 2 or transparent resin disk 4 is adhered to the light-permeable side of the lens 1, and then the lens 1 is covered on the casing of the lamp 3 with the transparent film 2 or transparent resin disk 4 facing the lamp bulb in the lamp 3 (see FIG. 2). When the lamp 3 is turned on, the image of the design in the transparent film 2 or sculpture in the transparent resin disk 4 is projected onto the lens 1 by light, and the image of the design in the transparent film 2 or sculpture in the transparent resin disk 4 is viewed from the outside through the light reflective side of the lens 1.

Figure 4:
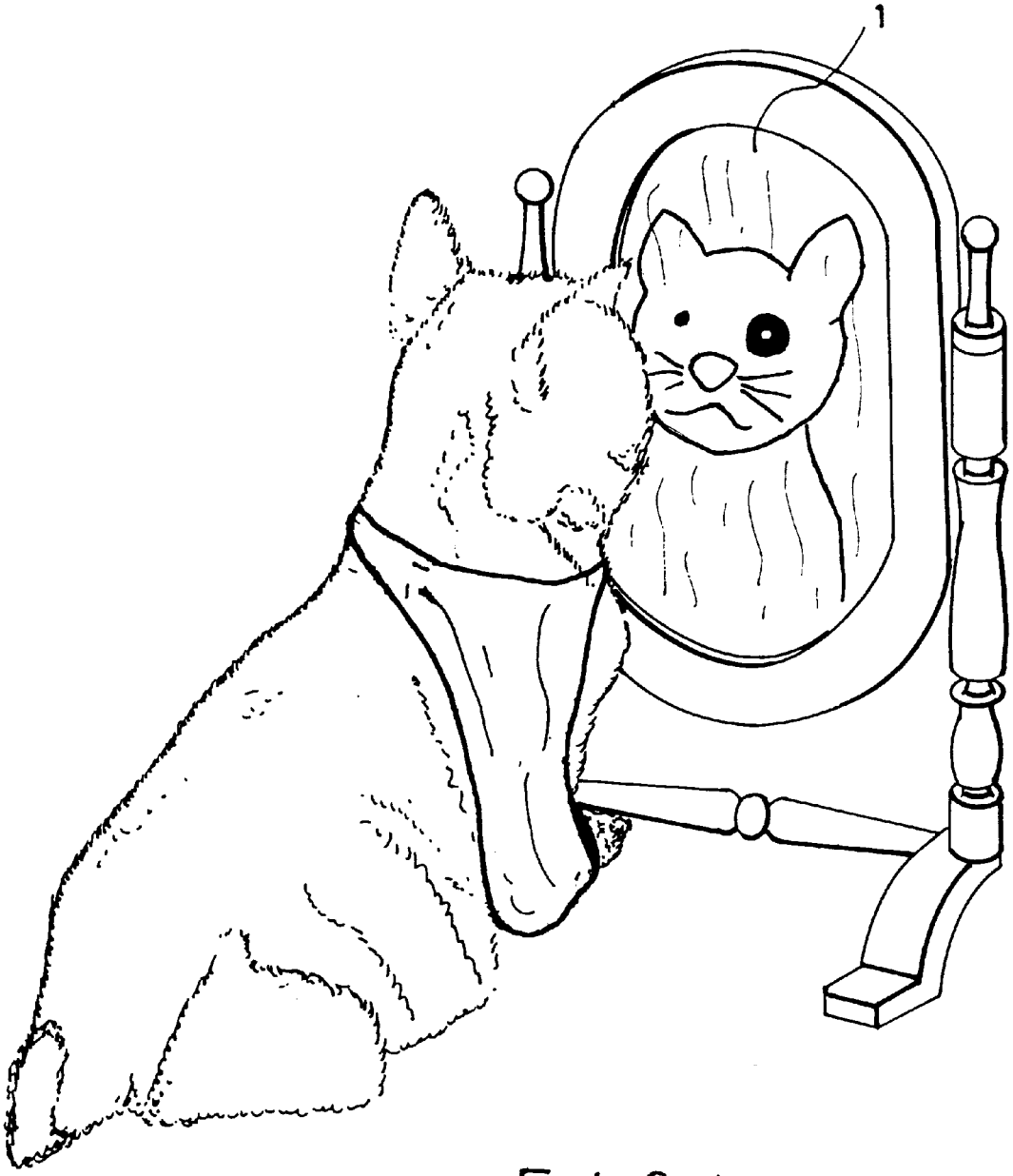
FIG. 4 shows an application example of the present invention in which the light source is turned off and the image of the cat appears in the lens.
Figure 5:
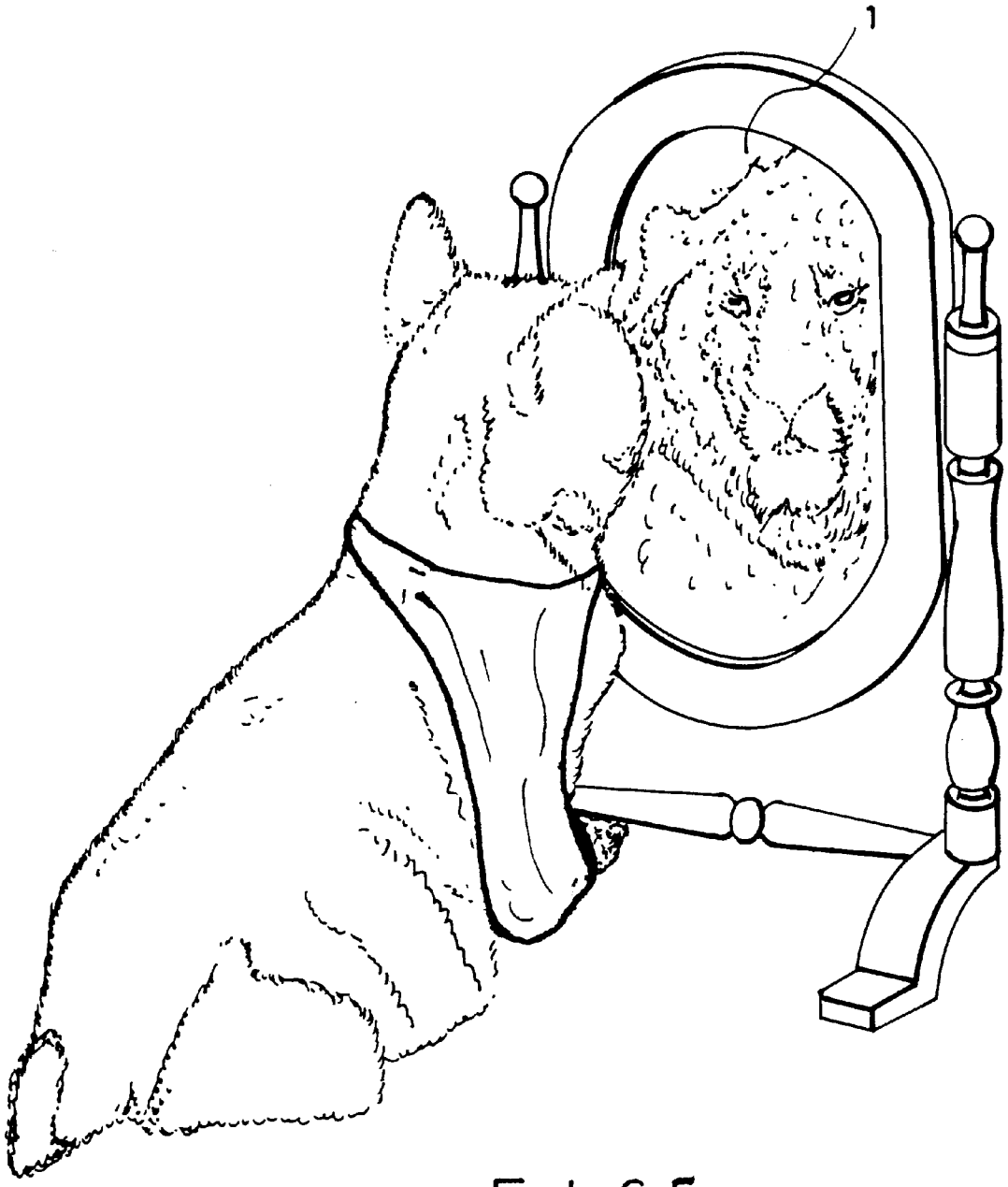
FIG. 5 is similar to FIG. 4 but showing the image of the cat disappeared, the image of a lion appeared in the lens.

FIGS. 4 and 5 show an application example of the present invention used in a magic mirror. When the light source of the projection ornament is turned off, the image of the insulted cat is reflected by the light reflective side of the lens 1 (see FIG. 4). When the light source of the projection ornament is turned on, the image of the insulated cat is disappeared, and the image of a lion (the design in the transparent film or sculpture in the transparent resin disk of the projection ornament) is projected onto the lens 1 by light.

Figure 6:
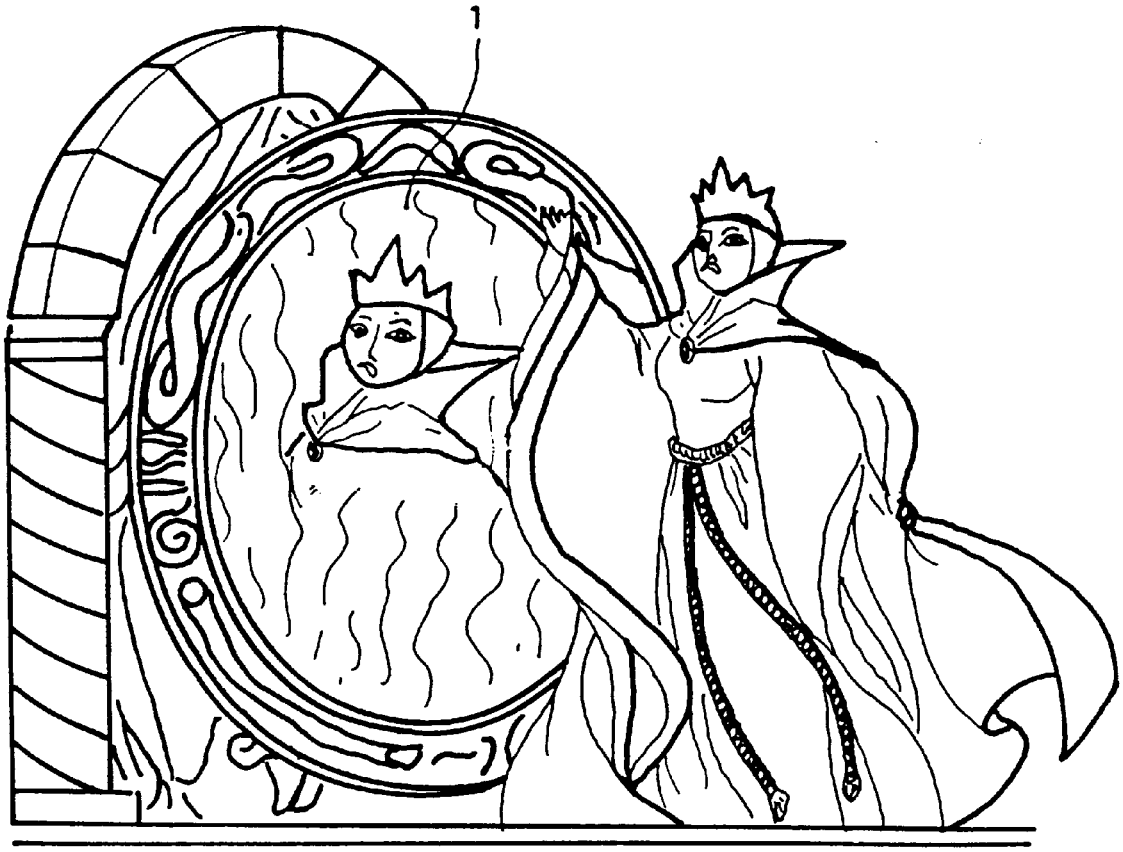
FIG. 6 shows another application example of the present invention in which the light source is turned off and the image of the queen appears in the lens.
Figure 7:
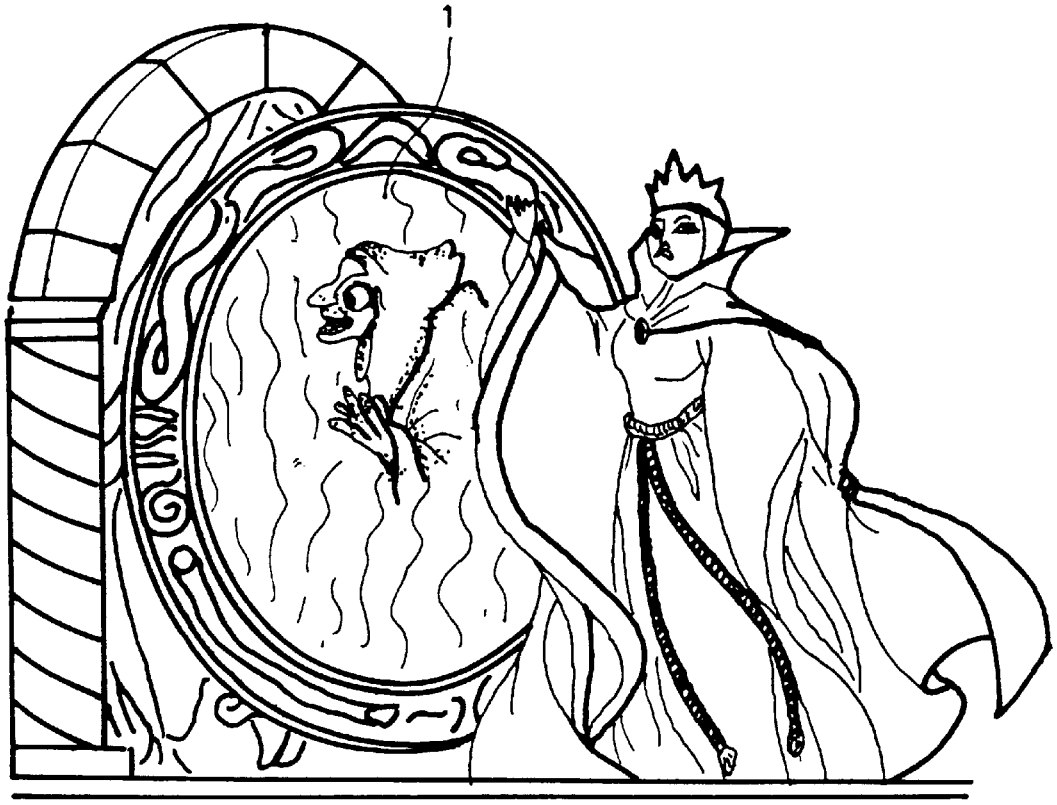
FIG. 7 is similar to FIG. 6 but showing the image of the queen disappeared, the image of a witch appeared in the lens.

FIGS. 6 and 7 show another application example of the present invention used in a magic mirror. When the light source of the projection ornament is turned off, the image of the queen is reflected by the light reflective side of the lens 1 (see FIG. 6). When the light source of the projection ornament is turned on, the image of the queen is disappeared, and the image of a witch (the design in the transparent film or sculpture in the transparent resin disk of the projection ornament) appears in the lens 1.

What is claimed is:

1. A projection ornament comprising a lens having a first side that admits light and a second side that reflects light, a light permeable element adhered to the first side of said lens, said light permeable element having a design in it, and a light source controlled to emit light through said light permeable element into the first side of said lens, said light permeable element being a transparent resin disk having a sculpture embedded therein.

* * * * *